US009410705B2

(12) United States Patent
Ryu et al.

(10) Patent No.: US 9,410,705 B2
(45) Date of Patent: Aug. 9, 2016

(54) GAS COOKER

(75) Inventors: Jung Wan Ryu, Changwon (KR); Dae Bong Yang, Changwon (KR); Jea Hyuk Wie, Changwon (KR); Yong Ki Jeong, Changwon (KR); Jae Bum Lim, Changwon (KR); Jun Ho Seok, Changwon (KR); Young Soo Kim, Changwon (KR); Yang Ho Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 1183 days.

(21) Appl. No.: 12/761,933

(22) Filed: Apr. 16, 2010

(65) Prior Publication Data

US 2010/0263658 A1 Oct. 21, 2010

(30) Foreign Application Priority Data

Apr. 17, 2009 (KR) ..... 10-2009-0033885

(51) Int. Cl.

*F24C 3/08* (2006.01)
*F24C 5/16* (2006.01)
*F23D 5/16* (2006.01)

(52) U.S. Cl.

CPC . *F24C 3/085* (2013.01); *F24C 3/08* (2013.01); *F24C 5/16* (2013.01); *F23D 5/16* (2013.01)

(58) Field of Classification Search

CPC ..... F24C 3/08; F24C 15/10; F24C 3/00; F24C 3/085; F23D 14/06; F23D 5/16
USPC ..... 126/39 E, 39 R, 214 D
See application file for complete search history.

(56) References Cited

U.S. PATENT DOCUMENTS

| | | | | | |
|---|---|---|---|---|---|
| 4,968,246 | A * | 11/1990 | Sasada | F24C 3/085 126/214 A |
| 5,408,984 | A * | 4/1995 | Maughan | 126/39 E |
| 6,679,699 | B2 * | 1/2004 | Yam et al. | 431/354 |
| 6,688,882 | B1 * | 2/2004 | Williams | 431/354 |
| 9,206,986 | B2 * | 12/2015 | Jeong | F24C 3/085 |

FOREIGN PATENT DOCUMENTS

| | | | |
|---|---|---|---|
| JP | 60-086722 | U | 12/1998 |
| KR | 20-1996-0018221 | U | 6/1996 |
| KR | 10-1998-0084551 | A | 12/1998 |
| KR | 10-2008-0095549 | A | 10/2008 |
| KR | 875238 | B1 * | 12/2008 |

OTHER PUBLICATIONS

Hwang B et al., Patent Application (for KR 875238), 2008, Korean Intellectual Property Office.*
[Translated]—Hwang B et al., Patent Application (for KR 875238), 2008, Korean Intellectual Property Office.*

* cited by examiner

*Primary Examiner* — Gregory Huson
*Assistant Examiner* — Aaron Heyamoto
(74) *Attorney, Agent, or Firm* — Birch, Stewart, Kolasch & Birch, LLP

(57) ABSTRACT

Provided is a gas cooker. When foods are cooked using a top burner, inclinations of main flame holes defined in the top burner are different according to positions of the main flame holes to prevent textile disposed adjacent to a front end of a top plate from burning. Thus, a user may further safely cook the foods.

7 Claims, 7 Drawing Sheets

GAS COOKER

CROSS-REFERENCE TO RELATED APPLICATIONS

The present application claims priority under 35 U.S.C. 119 and 35 U.S.C. 365 to Korean Patent Application No. 10-2009-0033885 (filed on Apr. 17, 2009), which is hereby incorporated by reference in its entirety.

BACKGROUND

The present disclosure relates to a cooker, and more particularly, to a gas cooker heating items to be cooked using gas.

A cooker refers to an electronic home appliance that heats items to be cooked (hereinafter, referred to as "foods") using gas or electricity. Especially, some cookers such as a gas range and a gas oven are equipped with a plurality of top burners. The top burner heats foods directly by a flame generated by burning gas. A plurality of the top burners is arranged at intervals on an upper surface of a top plate which forms an upper surface of the gas range or the gas oven.

SUMMARY

Embodiments provide a gas cooker that further safely usable.

In one embodiment, a gas cooker includes: a top plate; and at least two burners arranged spaced from each other in left and right directions in a row on a top surface of the top plate, each burner including a plurality of main flame holes for combustion of mixed gas, wherein a portion of a base part of the main flame holes of the burner adjacent to a front end of the top plate is inclined upward at a relatively large angle from the inside of the burner to the outside when compared to a remaining portion of the base part of the main flame holes of the burner.

In another embodiment, a gas cooker includes: a top plate; first and second front burners disposed in a row on left and right ends of the top plate; and at least one rear burner disposed at a rear end of a top surface of the tap plate, wherein the first and second front burners include: a first main flame hole in which a mixed gas for generating flame is exhausted, the first main flame hole being disposed in a portion of a section of the first and second front burners adjacent to the a front end of the top plate; and a second main flame hole in which the mixed gas for generating flame in a relatively radial direction on circumferences of the first and second front burners when compared to the first main flame hole is exhausted, the second main flame hole being disposed in a remaining section of the first and second front burners except the section in which the first main flame hole is defined.

In further another embodiment, a gas cooker includes: a top plate; at least one front burner disposed on a front end of a top surface of the top plate, the at least one front burner including a burner head in which a portion of a circumference thereof is cut to form a main flame hole and an auxiliary flame hole and a burner cap seated on a top surface of the burner head; and at least one rear burner disposed on a rear end of the top surface of the top plate corresponding to a rear side of the front burner, wherein a portion of a base part of the main flame hole of the front burner adjacent to the front end of the top plate is inclined upward at a relatively large angle from the inside of a circumference of the burner head to the outside when compared to a remaining portion of the base part of the main flame hole of the front burner.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Hereinafter, a gas cooker according to a first embodiment will be described in detail with reference to the accompanying drawings.

Figure 1:
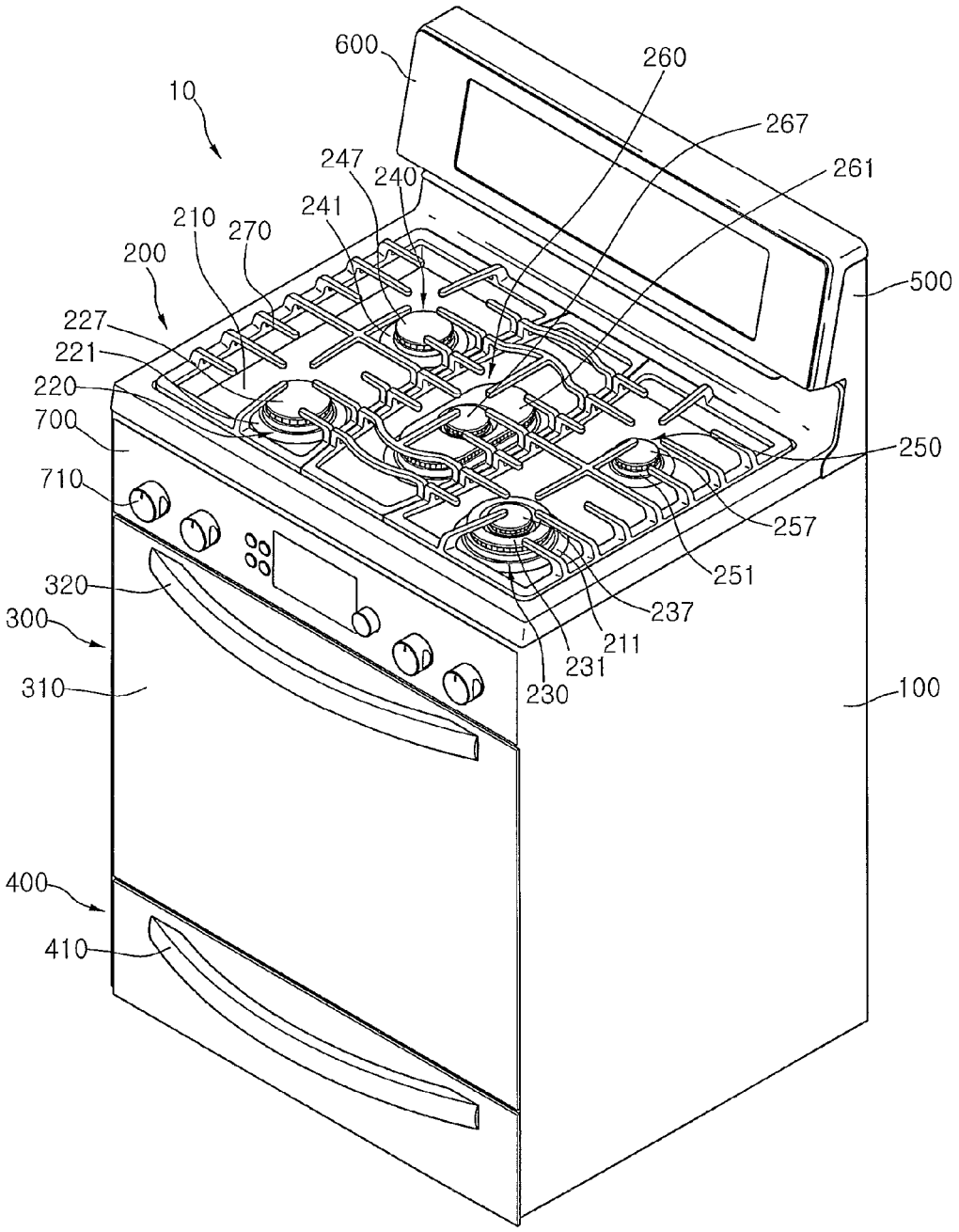
FIG. 1 is a perspective view of a gas cooker according to a first embodiment.
Figure 2:
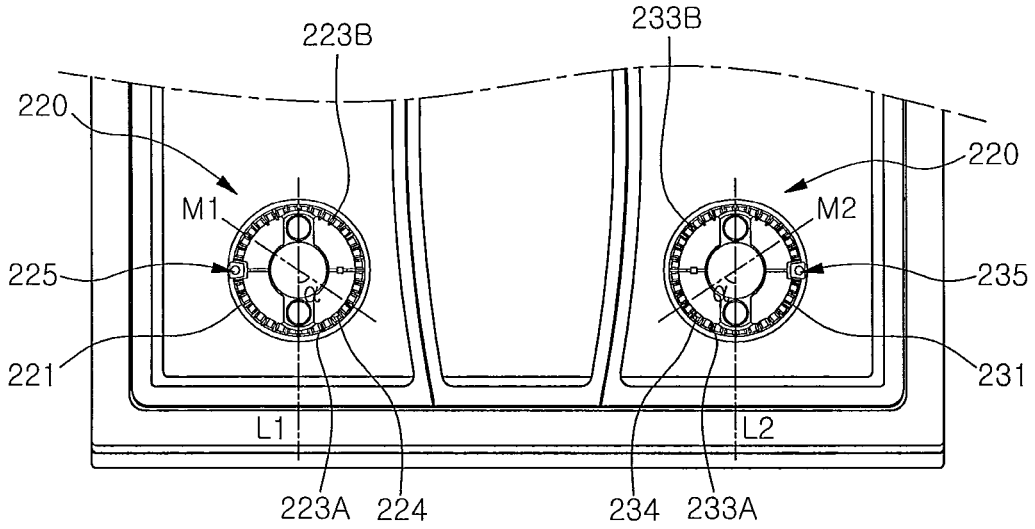
FIG. 2 is a plan view illustrating a main part of the gas cooker according to the first embodiment.
Figure 3:
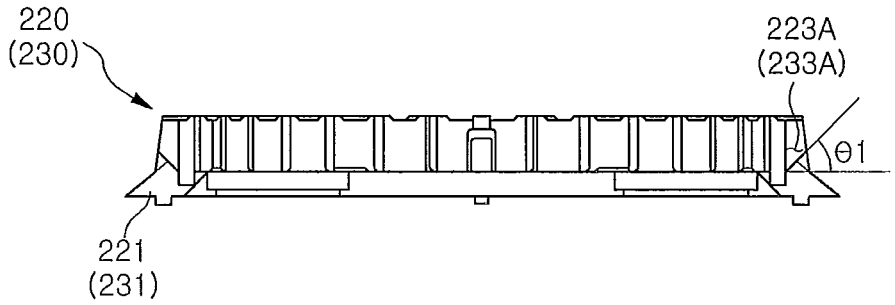
FIGS. 3 and 4 are sectional views illustrating a main part of the gas cooker according to the first embodiment.
Figure 4:
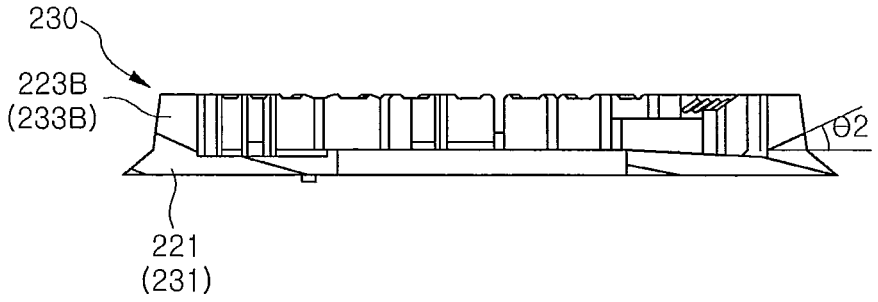

FIG. 1 is a perspective view of a gas cooker according to a first embodiment. FIG. 2 is a plan view illustrating a main part of the gas cooker according to the first embodiment. FIGS. 3 and 4 are sectional views illustrating a main part of the gas cooker according to the first embodiment.

Referring to FIG. 1, the gas cooker 10 includes a main body 100 forming an appearance thereof. The main body 100 includes a top burner unit 200, an oven unit 300, a warming drawer 400, a back guard 500, a control panel 600 and a top burner control unit 700.

The top burner unit 200 and the oven unit 300 cook foods therein. The warming drawer 400 heats a container holding the foods.

The control panel 600 is input with an operation signal for operation of the gas cooker 10 and displays various information related to the operation of the gas cooker 10 to the outside. The top burner control unit 700 opens and closes a valve which supplies gas to the top burner unit 200. The back guard 500 guides combustion gas generated during cooking of the foods in the oven unit 300.

More specifically, the top burner unit 200 is disposed at an upper end of the main body 100. The top burner unit 200 includes a plurality of top burners 220 burning gas and thereby heating a container holding the foods. The top burner 220 will be described in greater detail hereinafter.

Additionally, the top burner unit 200 is provided with a plurality of grates 270. The container to be heated by the top burner 220 is seated on the grate 270.

The oven unit 300 is disposed in the middle part of the main body 100, that is, under the top burner unit 200. A cooking chamber (not shown) is provided inside the oven unit 300. The foods are cooked by a heater (not shown) in the cooking chamber. The cooking chamber is selectively opened and closed by a door 310. The door 310 pivots up and down by its upper edge about its lower edge with respect to the main body 100, thereby opening and closing the cooking chamber. A door handle 320 is disposed on an upper front part of the door 310 for a user to grip when opening and closing the door 310.

The warming drawer 400 is disposed under the oven unit 300, that is, at a lower part of the main body 100. The warming drawer 400 is mounted to move in and out of the main body 100 in a drawer manner. The container holding the foods is received in the warming drawer 400 and heated by the heater of the cooking chamber or a separate heater for warming. The warming drawer 400 includes a drawer handle 410 disposed on an upper front part thereof for a user to grip to move the warming drawer 400 in and out.

The back guard 500 is disposed at an upper rear end of the main body 100, that is, a rear part of the top burner unit 200, extending upward from the upper surface of the main body 100. The back guard 500 includes a path formed therein in communication with the cooking chamber. Accordingly, combustion gas generated in the oven unit 300 while the foods is cooked in the cooking chamber flows through the path and is discharged out of the cooking chamber.

The control panel 600 is disposed on a front surface of the back guard 500. The control panel 600 includes an input part receiving various operation signals for actual operations of the oven unit 300 and the warming drawer 400 and a display part displaying various information related to the operations of the oven unit 300 and the warming drawer 400.

The top burner control unit 700 includes a plurality of operation knobs 710 provided corresponding to the top burners 220 in number. The operation knobs 710 selectively open and close valves that supply gas to the respective top burners 220.

The top plate 210 forms an upper appearance of the top burner unit 200. The top plate 210 includes burner mounting parts 211 to which the top burners 220 are mounted. The burner mounting parts 211 protrudes upward so that parts of the top plate 210 have substantially circular cross-sections. Therefore, upper surfaces of the burner mounting parts 211 are disposed relatively higher than an upper surface of the top plate 210.

The top burners 220 may include top burners 220, 230, 240, 250, and 260 arranged on the upper surface of the top plate 210 in at least two rows, for example, front and rear rows. More specifically, the top burners 220, 230, 240, 250, and 260 may be a first front burner 220, a second front burner 230, a first rear burner 240, a second rear burner 250, and a central burner 260. The first and second front burners 220 and 230 are disposed on the left and the right of a front upper surface of the top plate 210. The first and the second rear burners 250 and 250 are disposed on the left and the right of a rear upper surface of the top plate 210. The central burner 260 is disposed in the center of the top plate 210, i.e., between the first and second front burners 220 and 230 and the first and second rear burners 240 and 250. In the present embodiment, the central burner 260 has a substantial oval form extending in a forward and backward direction of the gas cooker 10.

The first and second front burners 220 and 230 include burner heads 221 and 231 and burner caps 227 and 237, respectively. Referring to FIG. 2, a plurality of main flame holes 223A, 223B, 233A, and 233B are defined in circumferences of the burner heads 221 and 231 of the first and second front burners 220 and 230. Mixed gas in which air and gas supplied into the first and second front burners 220 and 230 are mixed with each other is exhausted through and combusted at the main flame holes 223A, 223B, 233A, and 233B of the first and second front burners 220 and 230. The main flame holes 223A, 223B, 233A, and 233B of the first and second front burners 220 and 230 are spaced from centers of the first and second front burners 220 and 230 by a preset central angle and defined in the circumferences of the burner heads 221 and 231 of the first and second front burners 220 and 230, respectively. Auxiliary flame holes 224 and 234 are defined in the circumferences of the burner heads 221 and 231 of the first and second front burners 220 and 230 corresponding between the main flame holes 223A, 223B, 233A, and 233B of the first and second front burners 220 and 230, respectively. The auxiliary flame holes 224 and 234 of the first and second front burners 220 and 230 transfer flame to allow the mixed gas exhausted from the main flame holes 223A, 223B, 233A, and 233B of the first and second front burners 220 and 230 to burn. Also, lower ignition parts 225 and 235 are disposed at the burner heads 221 and 231 of the first and second front burners 220 and 230, respectively. Ignition plugs (not shown) for igniting the mixed gas exhausted from the main flame holes 223A, 223B, 233A, and 233B of the first and second front burners 220 and 230 are disposed on the lower ignition parts 225 and 235 of the first and second front burners 220 and 230, respectively. The lower ignition parts 225 and 235 of the fist and second front burners 220 and 230 are disposed sides of the circumferences of the burner heads 221 and 231 of the first and second front burners 220 and 230. Thus, the main flame holes 223A, 223B, 233A, and 233B of the first and second front burners 220 and 230 may not be defined at the sides of the circumferences of the burner heads 221 and 231 of the first and second front burners 220 and 230 corresponding to the lower ignition parts 225 and 235 of the fist and second front burners 220 and 230. Also, the burner caps 227 and 237 of the first and second front burners 220 and 230 are seated on top surfaces of the burner heads 221 and 231 of the first and second front burners 220 and 230, respectively.

Also, the first and second rear burners 240 and 250 and a central burner 260 include burner heads 241, 251, and 261 and burner caps 247, 257, and 267. The first and second rear burners 240 and 250 and the central burner 260 have the same structures as those of the first and second front burners 220 and 230. Thus, their detailed descriptions will be omitted.

A safety test with respect to the gas cooker may include a test that confirms whether a textile T burns at front sides of the first and second front burners 220 and 230, i.e., a position spaced a predetermined distance, e.g., about 4 inches, from a front end of the top burner unit 200 when the foods are heated using the first and second front burners 220 and 230. In this embodiment, to prevent the textile T from being burning in the above-described safety test, the outward inclinations of the main flame holes 223A, 223B, 233A, and 233B of the first and second front burners 220 and 230 were variably determined according to positions of the main flame holes 223A, 223B, 233A, and 233B of the first and second front burners 220 and 230.

In detail, referring to FIGS. 2 to 4, the main flame holes 223A, 223B, 233A, and 233B of the first and second front burners 220 and 230 include first and second main flame holes 223A, 223B, 233A, and 233B, respectively.

The first main flame holes 223A and 233A of the first and second front burners 220 and 230 are defined at the front sides of the first and second front burners 220 and 230, i.e., portions of the circumferences of the first and second front burners 220 and 230 adjacent to the front end of the top burner unit 200. For example, the first main flame holes 223A and 233A are defined in a region between virtual straight lines L1 and L2 passing through centers of the first and second front burners 220 and 230 in a direction perpendicular to that of the front end of the top burner unit 200 on the circumferences of the first and second front burners 220 and 230, respectively. In more detail, the first main flame holes 223A and 233A are defined within a section corresponding to a circular arc shape having a predetermined central angle $\alpha$, e.g., about 45°, in a counterclockwise or clockwise direction with respect to the straight lines L1 and L2. The second main flame holes 223B and 233B of the first and second front burners 220 and 230 are defined within a remaining section of the first and second front burners 220 and 230 except the portions of the circumferences of the first and second front burners 220 and 230 in which the first main flame holes 223A and 233A are defined.

The circumferences of the first and second front burners 220 and 230, particularly, portions of the circumferences of the burner heads 221 and 231 of the first and second front burners 220 and 230 are cut to define the first and second main flame holes 223A, 233A, 223B, and 233B, respectively. Base parts of the first and second main flame holes 223A, 233A, 223B, and 233B are inclined upward from the inside of the circumferences of the burner heads 221 and 231 of the first and second front burners 220 and 230 toward the outside, i.e., in a direction in which the mixed gas is exhausted through the first and second main flame holes 223A, 233A, 223B, and 233B. Here, in inclined angles of the base parts of the first and second main flame holes 223A, 233A, 223B, and 233B, the first main flame holes 223A and 233A have an inclined angle greater than that of the second main flame holes 223B and 233B. Thus, since flame generated by combustion of the mixed gas exhausted through the first main flame holes 223A and 233A is relatively adjacent to outer circumferences of the first and second front burners 220 and 230 when compared to flame generated by combustion of the mixed gas exhausted through the second main flame holes 223B and 233B, it may prevent the textile T from burning by the flame generated by combustion of the mixed gas exhausted through the first main flame holes 223A and 233A. In this embodiment, the base parts of the first and second main flame holes 223A, 233A, 223B, and 233B are inclined at predetermined angles θ1 and θ2, e.g., about 45° to about 25°, from the inside of the circumferences of the first and second front burners 220 and 230 to the outside. However, the inclined angles of the base parts of the first and second main flame holes 223A, 233A, 223B, and 233B are not limited thereto. That is, the base parts of the first main flame holes 223A and 233A may have an inclined angle relatively less than that of the base parts of the second main flame holes 223B and 233B. However, the inclined angles of the base parts of the second main flame holes 223B and 233B may have generally reasonable angle.

Hereinafter, an effect of the gas cooker according to the first embodiment will be described in detail with reference to the accompanying drawing.

Figure 5:
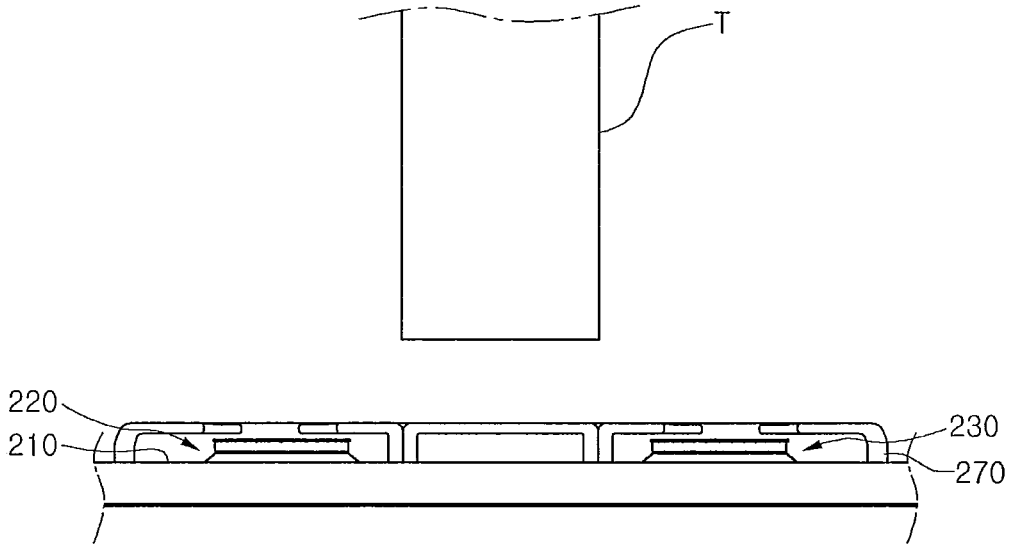
FIG. 5 is a view of a safety test process with respect to the gas cooker according to the first embodiment.

FIG. 5 is a view of a safety test process with respect to the gas cooker according to the first embodiment.

Referring to FIG. 5, the textile T is disposed adjacent to the front end of the top burner unit 200 corresponding to the front sides of the first and second front burners 220 and 230. In the safety test, it is necessary that the textile T is disposed at a position at which hot air generated by the first and second front burners 220 and 230 is relatively strong, i.e., a position spaced by about 4 inches, from a space corresponding between the first and second front burners 220 and 230 in a front direction. Also, according to the requirement of the safety test, the first and second front burners 220 and 230 are operated in an unloading state.

In this state, an operation knob 710 is operated to allow the mixed gas to burn by the first and second front burners 220 and 230. In more detail, the operation knob 710 may be operated to supply the mixed gas into the first and second front burners 220 and 230 and operate an ignition plug for the combustion of the mixed gas. It observes whether the textile T burns by the flame generated by the combustion of the mixed gas exhausted through the first and second main flame holes 223A, 233A, 223B, and 233B of the first and second front burners 220 and 230 for a period of time required for the safety test.

As described above, the first main flame holes 223A and 233A generating the flame relatively adjacent to the outer circumference of the first and second front burners 220 and 230 are defined in a region in which an intensity of the flame is relatively strong, i.e., circumferences of the first and second front burners 220 and 230 corresponding to the space between the first and second front burners 220 and 230. Thus, the combustion of the textile T due to the flame generated by the mixed gas exhausted through the first and second main flame holes 223A and 233A may be minimized. Also, since the flame generated by the combustion of the mixed gas exhausted through the remaining flame holes of the first and second front burners 220 and 230 except the first main flame holes 223A and 233A, i.e., the second main flame holes 223B and 233B is in the radial direction of the first and second front burners 220 and 230, the foods may be effectively heated by the first and second front burners 220 and 230 during the actual cooking process.

Hereinafter, a gas cooker according to a second embodiment will be described in detail with reference to the accompanying drawing.

Figure 6:
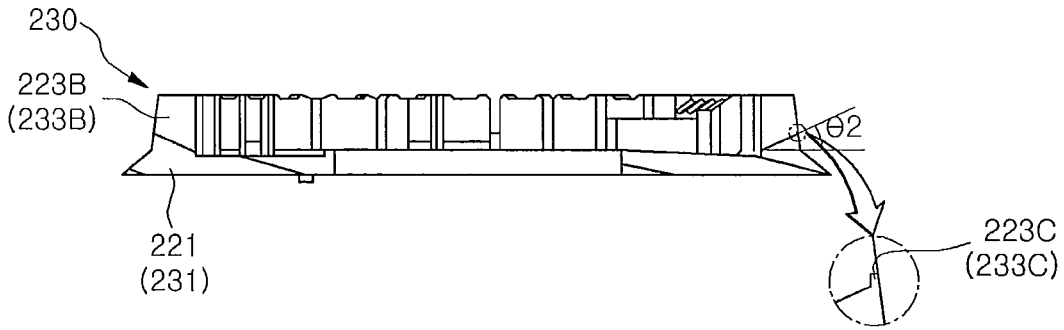
FIG. 6 is a sectional view illustrating a main part of a gas cooker according to a second embodiment.

FIG. 6 is a sectional view illustrating a main part of a gas cooker according to a second embodiment. The same parts as those of the first embodiment in parts of this embodiment will be denoted by the same reference numbers as those of FIGS. 1 to 5, and their detailed descriptions will be omitted.

Referring to FIG. 6, base parts of first and second main flame holes 223A, 233A, 223B, and 233B of first and second front burners 220 and 230 are inclined upward at the same angle θ2 from the inside of circumferences of the first and second front burners 220 and 230 to the outside.

In this embodiment, interference ribs 223C and 233C are disposed at outer ends of the base parts of the first main flame holes 223A and 233A, respectively. The interference ribs 223C and 233C extend upward from the outer ends of the base parts of the first main flame holes 223A and 233A. Thus, it may prevent a flame generated by combustion of mixed gas exhausted through the first main flame holes 223A and 233A from being spread in a radial direction of the first and second front burners 220 and 230. Thus, like the first embodiment, it may prevent a textile T from being ignited in a safety test process of the gas cooker.

Hereinafter, a gas cooker according to a third embodiment will be described in detail with reference to the accompanying drawing.

Figure 7:
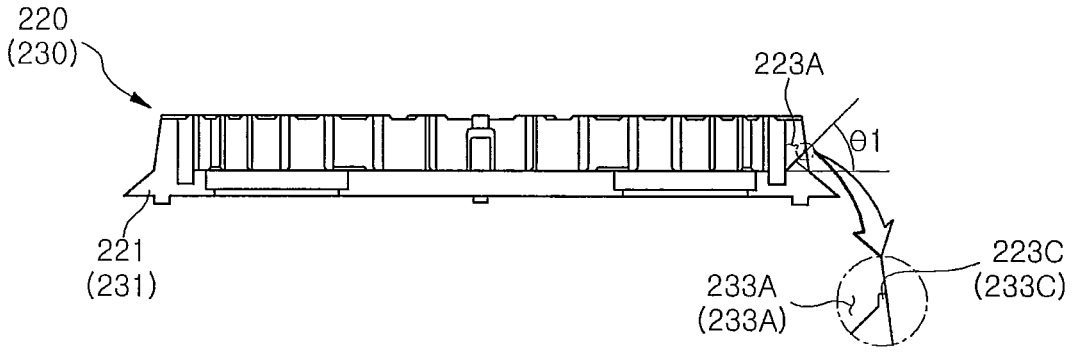
FIG. 7 is a sectional view illustrating a main part of a gas cooker according to a third embodiment.

FIG. 7 is a sectional view illustrating a main part of a gas cooker according to a third embodiment. The same parts as those of the first embodiment in parts of this embodiment will be denoted by the same reference numbers as those of FIGS. 1 to 5, and their detailed descriptions will be omitted.

Referring to FIG. 7, base parts of first and second main flame holes 223A, 233A, 223B, and 233B of first and second front burners 220 and 230 are inclined at an angles θ1 and θ2 different from each other. That is, the base parts of the first main flame holes 223A and 233A have the angle θ1 relatively less than that θ2 of the base parts of the second main flame holes 223B and 233B. This is equal to that of the first embodiment. In addition, like the second embodiment, interference ribs 223C and 233C are disposed at outer ends of the base parts of the first main flame holes 223A and 233A, respectively. Thus, according to this embodiment, the same effects as the first and second embodiments may be expected.

According to the embodiments, it is advantageous that the foods can be further safely cooked.

As described above, according to the embodiments, user's safety may be secured at the front side of the gas cooker by the top burner disposed at the front end of the top plate. Thus, it may expect that the user can further safely cook the foods using the gas cooker.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas cooker comprising:

a top plate; and at least two burners arranged spaced from each other in left and right directions in a row on a top surface of the top plate, each burner comprising a plurality of main flame holes for combustion of mixed gas, wherein the plurality of main flame holes comprises first main flame holes formed on only a first space corresponding to a first angle range with respect to a center of the burner and second main flame holes formed on only a second space corresponding to a second angle range with respect to the center of the burner, wherein the first and second angle ranges do not overlap and add up to 360 degrees, the second angle range being greater than the first angle range, wherein a first inclined angle of a first base part forming each first main flame hole relative to the top surface of the top plate is greater than a second inclined angle of a second base part forming each second main flame hole relative to the top surface of the top plate, wherein the first main flame holes are disposed in only a section between a first straight line L1 and a second straight line L2 parallel to each other and parallel to the top surface of the top plate, the first straight line L1 passing through one of the two burners, and the second straight line L2 passing through an other of the two burners, the first and second straight lines L1 and L2 extending in a front and rear direction of the top plate, and wherein a lowest point of the first base part and a lowest point of the second base part have a same height with respect to the top plate.

2. The gas cooker according to claim 1, wherein the first main flame holes are disposed within a section corresponding to a circular arc shape having a preset central angle with respect to the straight lines L1 and L2.

3. The gas cooker according to claim 1, wherein the first main flame holes are disposed within a section corresponding to a circular arc shape having a central angle of about 45° in a preset direction with respect to the straight lines L1 and L2.

4. The gas cooker according to claim 3, wherein the at least two burners comprises a left burner and a right burner, wherein, in the left burner, the first main flame holes are disposed in a section corresponding to a circular arc shape having a central angle of about 45° in a counterclockwise direction with respect to the straight line L1, and in the right burner, the first main flame holes are disposed in a section corresponding to a circular arc shape having a central angle of about 45° in a clockwise direction with respect to the straight line L2.

5. The gas cooker according to claim 1, wherein the first inclined angle is equal to or greater than 45° and the second inclined angle is equal to or less than 25°.

6. A gas cooker comprising:

a top plate;

first and second front burners disposed in a row on left and right ends of the top plate;

and at least one rear burner disposed at a rear end of a top surface of the top plate, wherein the first and second front burners comprise:

first main flame holes in which a mixed gas for generating flame is exhausted, the first main flame holes being formed on only a first space corresponding to a first angle range with respect to a center of the first and second front burners adjacent to a front end of the top plate;

second main flame holes in which the mixed gas for generating flame is exhausted, the second main flame holes being formed on only a second space corresponding to a second angle range with respect to the center of the burner, wherein the first and second angle ranges do not overlap and add up to 360 degrees , wherein the second angle range is greater than the first angle range, wherein an interference rib is disposed at an outer end of a first base part of the first main flame holes to prevent a flame generated by combustion of the mixed gas exhausted through the first main flame holes from being spread in a radial direction on circumferences of the first and second front burners, wherein a first inclined angle of the first base part forming each first main flame hole relative to the top surface of the top plate is greater than a second inclined angle of a second base part forming each second main flame hole relative to the top surface of the top plate, wherein the first main flame holes are disposed in only a section between a first straight line L1 and a second straight line L2 parallel to each other and parallel to the top surface of the top plate, the first straight line L1 passing through one of the burners, and the second straight line L2 passing through an other of the burners, the first and second straight lines L1 and L2 extending in a front and rear direction of the top plate, and wherein a lowest point of the first base part and a lowest point of the second base part have a same height with respect to the top plate.

7. The gas cooker according to claim 6, wherein, in the first front burner disposed at a relatively left side, the first main flame holes are defined in a section corresponding to a circular arc shape having a central angle of 45° in a counterclockwise direction with respect to the straight line L1, and wherein, in the second front burner disposed at a relatively right side, the first main flame holes are defined in a section corresponding to a circular arc shape having a central angle of about 45° in a clockwise direction with respect to the straight line L2.

* * * * *